US005845889A

United States Patent [19]

Suzuki

[11] Patent Number: 5,845,889

[45] Date of Patent: Dec. 8, 1998

[54] PAPER CLIP

[75] Inventor: Hitoshi Suzuki, Tokyo, Japan

[73] Assignee: Hiromori Inc., Tokyo, Japan

[21] Appl. No.: 919,004

[22] Filed: Aug. 27, 1997

[30] Foreign Application Priority Data

Jul. 9, 1997 [JP] Japan ..... 9-199236

[51] Int. Cl.[6] ..... A47B 97/04

[52] U.S. Cl. ..... 248/451; 24/67.11; 40/658; 248/442.2

[58] Field of Search ..... 248/451, 454, 248/442.2, 316.5; 40/652, 658; 24/67.11

[56] References Cited

U.S. PATENT DOCUMENTS

| | | | |
|---|---|---|---|
| 4,097,971 | 7/1978 | Morris | 40/658 X |
| 4,261,121 | 4/1981 | Coon | 40/658 X |
| 4,525,899 | 7/1985 | Carroll | 24/67.11 X |
| 5,621,950 | 4/1997 | White | 24/67.11 |
| 5,667,183 | 9/1997 | Hiromori | 248/451 |
| 5,697,594 | 12/1997 | Adams et al. | 248/442.2 |

FOREIGN PATENT DOCUMENTS 63-23169 6/1988 Japan .

*Primary Examiner*—Ramon O. Ramirez
*Attorney, Agent, or Firm*—Dilworth & Barrese

[57] ABSTRACT

The present invention provides a paper clip which can not merely supports the upstanding of a document such as a manuscript but also support it in such a manner that it is arranged at a position and an orientation easy to view.

To this end, there are first formed a convex clamping member 2 having at its fore part a clamping surface 2*a* which has been curved into a convexed plane and a concave clamping member 3 having at its fore part a clamping surface 3*a* which has been curved into a concaved plane. The convex clamping member 2 and the concave clamping member 3 are arranged such that their respective clamping surfaces 2*a* and 3*a* are brought into snug abutment against each other, with operative portions 7 and 8 being pressed against a biasing force of a spring to pivotably open a clamping portion 10 around a pivot 6. A fixed base plate 4 having an anchoring member 5 is coupled relative to and continuous with the rear end of the concave clamping member 3 in such a manner as to be pivotable around a pivot 14, thus obtaining a paper clip 1.

4 Claims, 4 Drawing Sheets

PAPER CLIP

BACKGROUND OF THE INVENTION

1. Field of the Invention

The present invention relates generally to a clamping tool for clamping paper leaves or the like, and more particularly to a paper clip capable of clamping and supporting in an arbitrary orientation with a curved state easy to view a single or a multiplicity of documents such as manuscripts upon the operation of word processors, typewriters or personal computers, as well as capable of supporting and clamping a price list, a recipe for the housewives, etc., in an arbitrary orientation with a curved state easy to view.

2. Description of the Related Art

Paper clips are known as one of clamping tools by means of which a plurality of paper leaves in stack are partly clamped to be neatly bundled together without being undesirably loosened. The paper clip comprises a pair of clamping plates each having its fore part a rectilinear surface and being coupled together in a pivotable manner, and a resilient element arranged between the pair of clamping plates for urging the clamping surfaces at their fore parts into mutual pressure contact.

Due to its aim to merely clamp the paper leaves or the like neatly without any undesirable disorder, the conventional paper clip was not suitable the use for clamping a single or a plurality of paper leaves or the like, that is, documents such as manuscripts upon the operation of the word processor, the typewriters or the personal computers, while simultaneously enabling them to be arranged in a location easy to view in which they are in parallel with the equipment such as word processor. It was also impossible for the conventional paper clip to create an environment to ensure a state easy to view without being unintentionally curled up or folded by winds or the like.

In order to not merely clamp a plurality of documents such as manuscripts in bundle but also to arrange them in a position or state easy to view, it is conceivable to suspend the documents from the above or to dispose the documents in an upstanding manner on the mount table such as a desk. In the first method, it is difficult to secure the place to suspend the paper clip, and a separate member for suspending the same is required. In addition, its clamping surface is flat and rectilinear in accordance with the contour of the surface of the paper leaves or the like, thus entailing a possibility to make it difficult to handle the documents under suspended state due to unintentional curling up of the documents arising from wind. On the contrary, in the latter method, the endeavor to secure the place to mount thereon the paper clip is not required but instead means for maintaining the documents in an upstanding manner must be required. In addition, in the case where the clamping surfaces are flat and rectilinear in accordance with the contour of the paper leaves in the same manner as the above, there may also be a possibility hard to handle the upstanding documents due to wind or their own weight, thus making it impossible to easily arrange it in a location easy to view while clamping the documents in bundle.

In an endeavor to render the documents such as or to create an environment ensuring a state easy to view. manuscripts easy to view, Japanese Utility Model Laid-open Pub. No. Sho59-24383 describes and proposes a paper piece supporting stand by means of which the documents are curved as if user's thumb is applied to the vicinity of center of the front bottom end of the documents, with the remaining fingers being applied to the back surface of the documents, to thereby clamp the documents by fingers such as thumb, thus enabling the paper leaves or the like to be kept upright with a strength due to stretch of the paper leaves or the like and to maintain them without allowing an unintentional folding.

However, the paper piece stand described in the above Japanese Utility Model Laid-open Pub. No. Sho59-24383 is so arranged that the paper leaves or the like are retained at their lower ends and caused to curve, with the result that the top ends thereof may possibly be unintentionally folded down if they are too long in the longitudinal direction or too large in entirety. Thus, unless the stand itself of the paper stand is enlarged or alternatively unless the paper piece insertion port is elongated in its depth direction, it was difficult to keep the paper leaves or the like in a preferred condition.

Moreover, the paper piece insertion port of the paper piece stand is comprised of a groove formed between the two supporting members so that the paper leaves or the like merely rest therein for retention in a curved manner. It was thus impossible to retain in a suitable manner a plurality of paper leaves or the like in bundle in correspondence with thickness of the superposed paper leaves.

Due to its aim to merely upright retain the paper leaves, the paper piece stand is three-dimensionally bulky, thus rendering the user very troublesome upon the retraction in no use, and unable to perform prompt and easy deployment in use and retraction in no use.

SUMMARY OF THE INVENTION

The present invention was conceived to solve the above problems and succeeded in achieving the object by the completion of the present invention described hereinbelow.

According to the present invention, paper leaves or the like are clamped by the clamping members each having a curved clamping surface, one the clamping members being attachable to the vertical surface, the clamping members being collapsible in a planar manner. Thus, by clamping the paper leaves or the like with the clamping members having their respective curved clamping surfaces, the paper leaves or the like can be easily supported in an upstanding manner irrespective of the number or the thickness of the leaves. Furthermore, by enabling the clamping members to be attached to the vertical surface, the direction of the clamping relative to the paper leaves or the like can be varied irrespective of the sizes of the paper leaves or the like. In addition, by enabling the clamping member to be folded to allow a planar retraction, there can be achieved a prompt deployment in use and a prompt retraction in no use.

According to an aspect of the present invention there is provided a paper clip comprising: a convex clamping member having at its fore part a clamping surface which has been curved into a convexed plane; a concave clamping member having at its fore part a clamping surface which has been curved into a concaved plane so as to fit the contour of the clamping surface of the convex claming member; a fixed base plate having an anchoring member, the base plate being pivoted continuously to the rear end of either the convex clamping member or the concave clamping member, the convex clamping member and the concave clamping member being abutted against each other to form a clamping portion, the convex clamping member and the concave clamping member being coupled with each other via a pivot in such a manner that the clamping portion is separated by pressing the vicinity of the rear end; and a resilient member arranged between the convex clamping member and the concave clamping member for biasing their respective clamping surfaces so as to allow the resilient member to come into pressure contact with the clamping surfaces.

The front surface of the fixed base plate and the back surface of either the convex clamping member or the concave clamping member are both flat to allow the paper clip to be bifolded with the front surface and the back surface being snugly abutted against each other. The anchoring member is of a type allowing an attachment to the vertical surface.

In this manner, the manuscripts such as paper leaves are retained by the curved clamping portions whose clamping surfaces are brought into pressure contact with each other by virtue of the biasing force of a spring, so that when the vicinities of the rear ends of the clamping members are pressed, the clamping portion is opened such an extent to allow an easy insertion of a multiplicity of paper leaves, thick paper leaves or the like. When the clamping portion is closed, the paper leaves or the like are curved in accordance with the contours of the clamping surfaces, as if the paper leaves or the like were curved and retained in an upstanding manner by user's single hand, that is, as if user's thumb were applied to the vicinity of the center of the front bottom of the paper leaves or the like, with the remaining fingers being applied to the back surface of the document. Thus, the paper leaves or the like can be retained in a bundle manner with a secure upstanding posture under pressure contact due to strength arising from the stretch of the paper leaves or the like, thereby maintaining the state without being folded undesirably. In addition, the anchoring member can be fixed to the vertical attachment surface, so that the thus clamped paper leaves or the like can be maintained in a state (orientation and angle) easy to view upon the operation of the word processor or the like. Furthermore, due to the ability to be bifolded in a planar manner, an easy retraction can be achieved with a bulkless manner.

BRIEF DESCRIPTION OF THE DRAWINGS

The above and other objects, aspects, features and advantages of the present invention will become more apparent from the following detailed description with reference to the accompanying drawings, in which.

DESCRIPTION OF THE PREFERRED EMBODIMENTS

Figure 1:
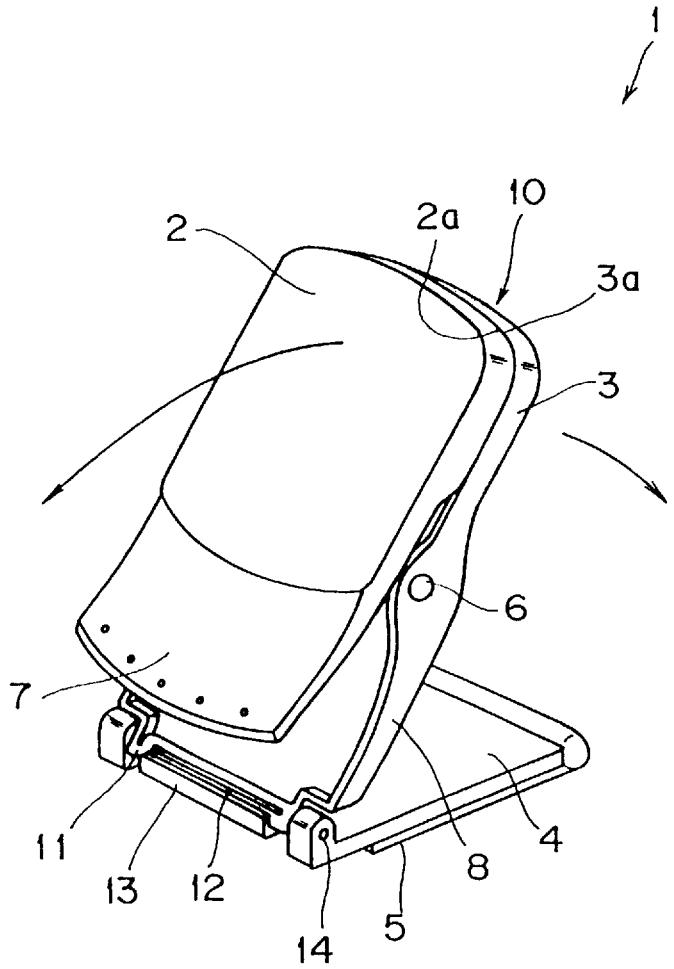
FIG. 1 is a perspective view of a paper clip in accordance with the present invention.
Figure 2:
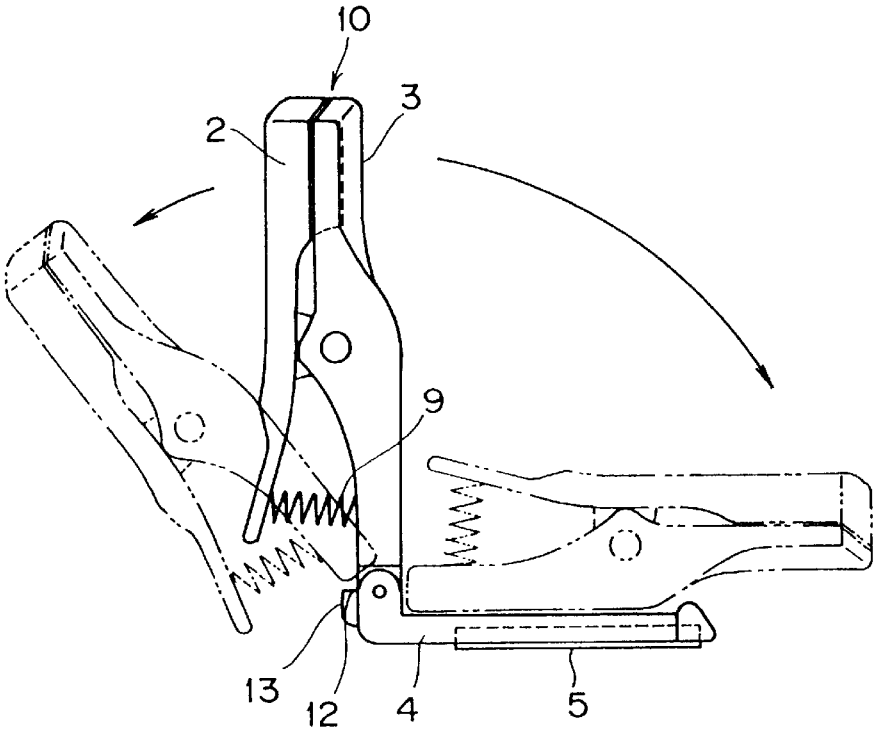
FIG. 2 is a side elevational view for explaining the action of the paper clip in accordance with the present invention.
Figure 3:
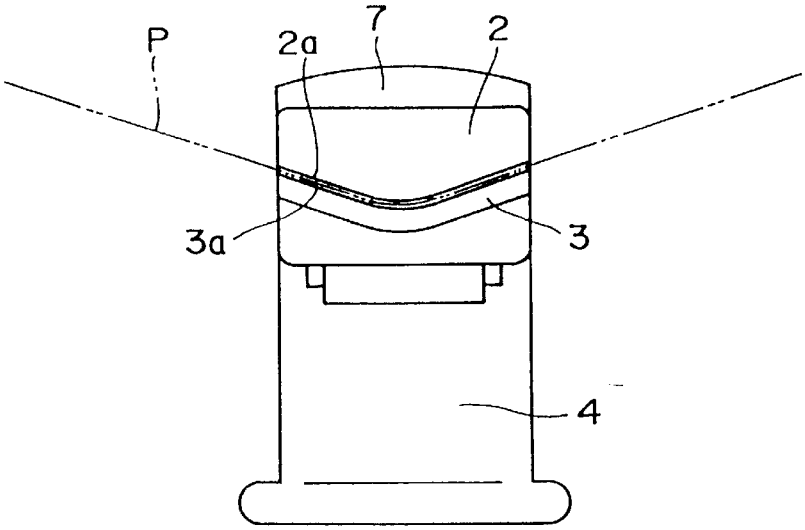
FIG. 3 is a top plan view of a clamping portion of the paper clip in accordance with the present invention.

An embodiment of the present invention will now be described with reference to the accompanying drawings. Referring to FIGS. 1 to 3, a paper clip of the present invention is generally designated at 1 and comprises two clamping members molded from synthetic resin, that is, a convex clamping member 2 having at its fore part a clamping surface 2*a* which has been curved into a convexed plane, and a concave clamping member 3 having at its fore part a clamping member 3*a* which has been curved into a concaved plane so as to fit the contour of the clamping surface 2*a* of the convex clamping member 2. The clamping surfaces 2*a* and 3*a* of the convex clamping member 2 and concave clamping member 3 are so arranged as to snugly abut against each other, with a resilient element 9 comprised of a coiled spring being sandwiched between the convex clamping member 2 and the concave clamping member 3. The convex clamping member 2 and the concave claming member 3 are pressed at their respective rear ends and their vicinities acting as operative portions 7 and 8, respectively, to force the clamping surface 2*a* of the convex clamping member 2 and the clamping surface 3*a* of the concave clamping member 3 to come apart from each other around a pivot 6 to open a claming portion 10. The two members are thus pivotally coupled together. A fixed base plate 4 is further provided which is pivotable relative to and continuous with the rear end of the concave clamping member 3.

The clamping surfaces 2*a* and 3*a* of the convex clamping member 2 and the concave claiming member 3 snugly abut against each other to define the clamping portion 10 and are urged into pressure contact with each other by means of the resilient element 9. Thus, by pressing the convex clamping member 2 and the concave clamping member 3 through their respective operative portions 7 and 8, the clamping portion 10 is caused to open, whereas by releasing the pressing against the operative portions 7 and 8 the clamping portion 10 is allowed to close with pressure contact by the biasing force of the resilient element 9. The resilient element 9 is not intended to be limited to the tubular coiled spring comprised of a generally spirally wound linear element, but instead may be a substantially V-shaped coiled spring having a wound portion formed at the center of the linear element, or a U-shaped plate spring comprised of an elongated thin plate having both ends bent to come closer to each other.

The fixed base plate 4 is attached pivotally on a pivot 14 relative to and continuous with the rear end of the concave clamping member 3. A linear protrusion 12 formed on a base shaft 11 at the rear end of the concave clamping member 3 is engaged with an elastic locking piece 13 formed at the front end of the fixed base plate 4, to thereby allow the concave clamping member 3 and therefore also the convex clamping member 2 to be tilted at an arbitrary angle relative to the fixed base plate 4. The fixed base plate 4 has on its back side an anchoring member 5 such as a magnet, a sucking disk or adhesion tape, thereby enabling the paper clip 1 to be mounted not only on a horizontal base surface but also on a vertical surface.

Moreover, the back surface of the concave clamping member 3 and the front surface of the fixed base plate 4 are both formed to be flat so that the engagement of that back surface with that front surface will result in a parallel relationship between the concave clamping member 3 and the fixed base plate 4, enabling the paper clip to be bifolded.

Figure 4:
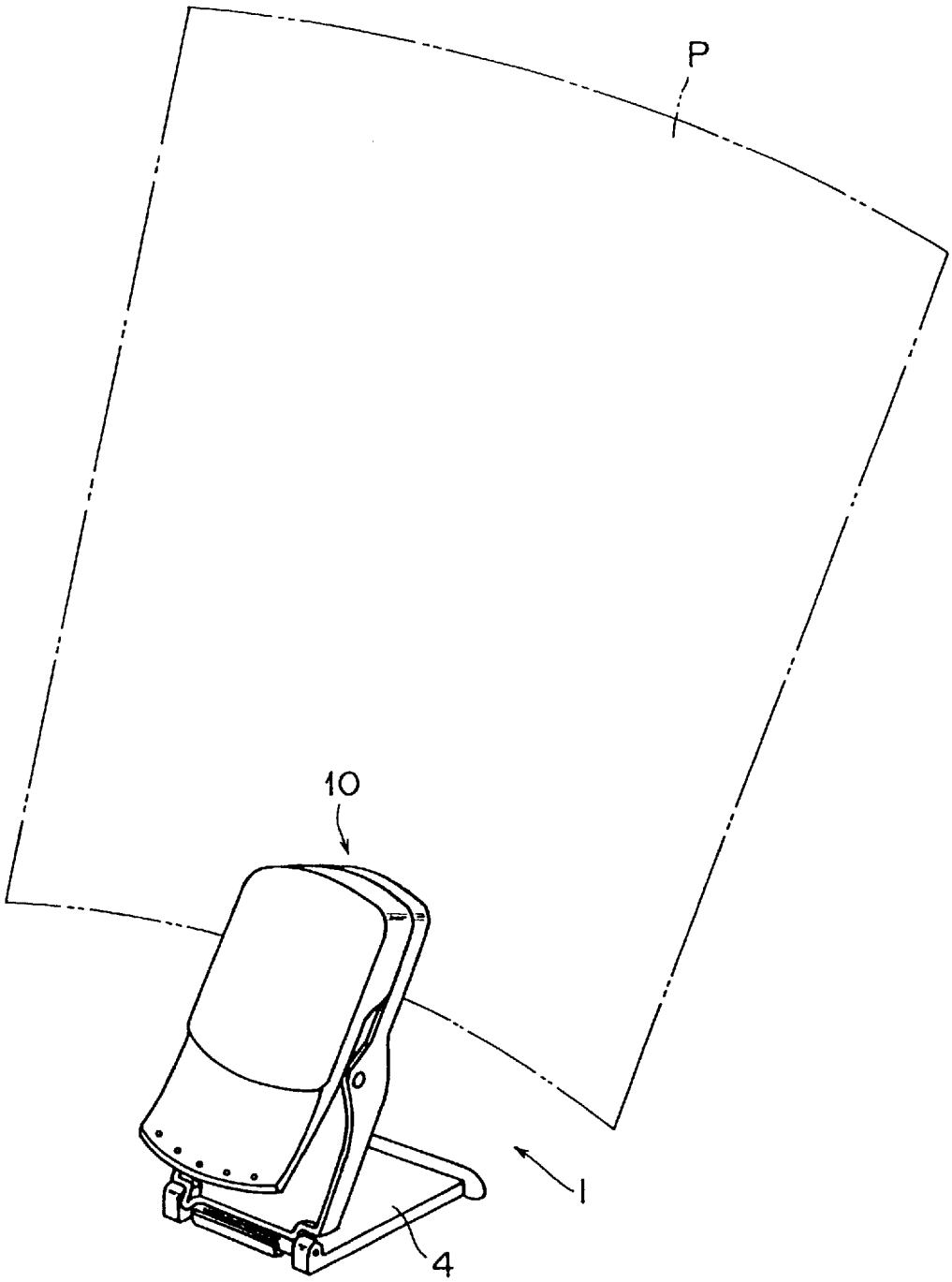
FIG. 4 is a perspective view showing the state of use of the paper clip in accordance with the present invention.
Figure 5A:
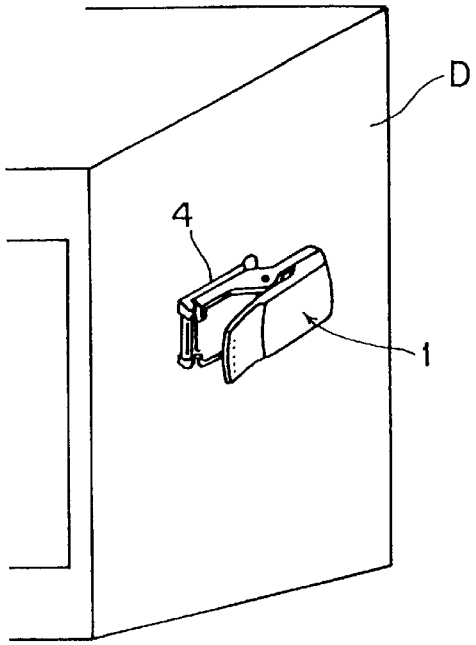
FIGS. 5A and 5B are perspective views showing the bifolded state and the deployed state respectively of the paper clip in accordance with the present invention.
Figure 5B:
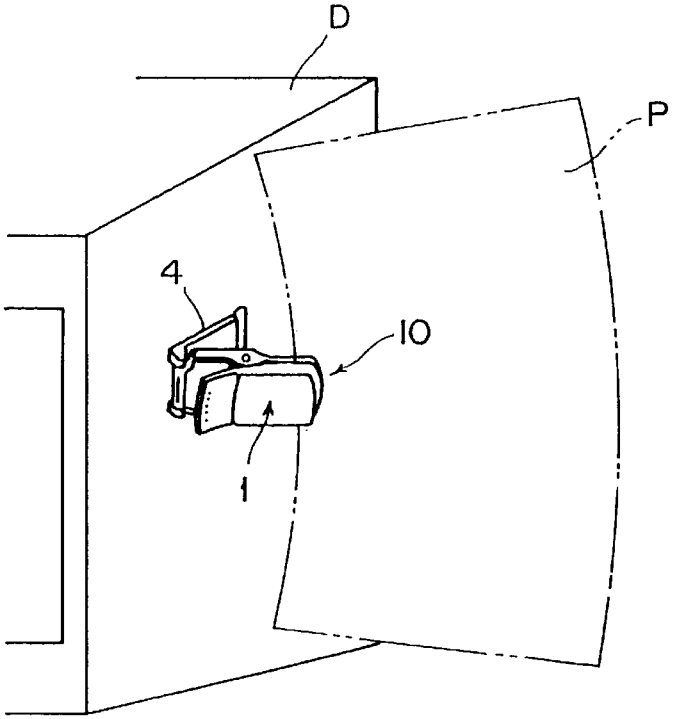

As shown in FIG. 4, the thus constructed paper clip 1 may be mounted through its fixed base plate 4 on a horizontal base surface with its clamping portion 10 upward directed, to thereby clamp e.g., paper leaves P in such a manner that the paper leaves P can rise up with a transversely curved state in accordance with the contour of the clamping surface of the clamping portion 10. Alternatively, as shown in FIG. 5, the paper clip 1 may be mounted through its fixed base plate 4 on a vertical surface such as a side surface of a display D for a personal computer, to thereby clamp paper leaves P with its clamping portion 10 transversely directed in such a manner that the paper leaves or the like can stretch transversely with a vertically curved state in accordance with the contour of the clamping surface of the clamping portion 10.

Due to the fact that the concave clamping member 3 is pivotable relative to the fixed base plate 4 in this case, there can be freely created circumstances easy to view a manuscript such as a paper leaf upon the operation of equipment such as a word processor, merely by adjusting the degree of pivoting, that is, the angle of inclination.

According to the present invention as described hereinbefore, documents or the like in a bundle are allowed to rise up free from unintentional folding with a state clamped by extremely simple means for clamping the documents in a curved manner which is similar to the clamping action using fingers, as if the documents such as manuscripts are held by single hand, the thumb being abutted against the central portion at the front bottom with the remaining fingers being abutted against the back surface of the documents. In addition, with the document being clamped, the paper clip of the present invention can create a document arranging environment which is suitable for the operation of equipment such as a word processor, thus eliminating the necessity to provide a special member for creating an environment which is suitable for the operation of equipment such as the word processor. Furthermore, due to its ability to be bifolded in a planar manner, the deployment in use and retraction in no use can be rapidly and readily carried out. The paper clip can be bifolded in a bulkless manner.

While an illustrative and presently preferred embodiment of the present invention has been described in detail herein, it is to be understood that the inventive concepts may be otherwise variously embodied and employed and that the appended claims are intended to be construed to include such variations except insofar as limited by the prior art.

What is claimed is:

1. A paper clip comprising:

a convex clamping member having at its fore part a clamping surface which has been curved into a convexed plane;

a concave clamping member having at its fore part a clamping surface which has been curved into a concaved plane so as to fit the contour of said clamping surface of said convex claming member;

a fixed base plate having an anchoring member, said base plate being pivoted continuously to a rear end of either the convex clamping member or the concave clamping member, said convex clamping member and said concave clamping member being abutted against each other to form a clamping portion, said convex clamping member and said concave clamping member being coupled with each other via a pivot in such a manner that said clamping portion is separated by pressing the vicinity of the rear end; and a resilient member arranged between said convex clamping member and said concave clamping member for biasing their respective clamping surfaces so as to allow said resilient member to come into pressure contact with said clamping surfaces.

2. A paper clip according to claim 1, wherein a front surface of said fixed base plate and a back surface of either said convex clamping member or said concave clamping member are both flat to allow said paper clip to be bifolded with said front surface and said back surface being abutted against each other.

3. A paper clip according to claim 1, wherein said anchoring member is structured and arranged to adhere to a vertical surface.

4. A paper clip according to claim 2, wherein said anchoring member is structured and arranged to adhere to a vertical surface.

* * * * *